US005211203A

United States Patent [19]

Vollweiler et al.

[11] Patent Number: 5,211,203

[45] Date of Patent: May 18, 1993

[54] PORTABLE SELF-CONTAINED GROUND WATER TESTING ASSEMBLY

[76] Inventors: Timothy J. Vollweiler; Arthur R. Vollweiler, both of 105 Harrison, American Falls, Id. 83211

[21] Appl. No.: 883,674

[22] Filed: May 15, 1992

[51] Int. Cl.[5] ..... B65H 75/34; B08B 3/00

[52] U.S. Cl. ..... 137/355.17; 137/355.21; 137/355.26; 134/151; 134/166 C

[58] Field of Search ..... 137/355.17, 355.2, 355.21, 137/355.26; 134/151, 166 C

[56] References Cited

U.S. PATENT DOCUMENTS

| | | | |
|---|---|---|---|
| 2,595,655 | 5/1952 | Hannay | 137/355.2 |
| 2,651,312 | 9/1953 | McBeth | 134/151 |
| 3,621,893 | 11/1971 | Nishimura | 134/166 R |
| 3,774,630 | 11/1973 | Prange | 137/355.26 |

FOREIGN PATENT DOCUMENTS

| | | | |
|---|---|---|---|
| 976836 | 10/1975 | Canada | 137/355.16 |

*Primary Examiner*—A. Michael Chambers
*Attorney, Agent, or Firm*—K. S. Cornaby

[57] ABSTRACT

A portable ground water sampling apparatus has a submersible pump or other water sampling apparatus attached through a hose to a hydraulically driven spool mounted on a boom attached to the bed of a truck or trailer. The hydraulically operated boom enables the operator to place the pump over the well and lower the pump into the well from the spool. A second spool also mounted on the boom operates a cable attached to a discrete liquid sampler or appliance of operator's choice for lowering into the well to take water samples or collect data. A decontamination apparatus is also attached to the boom and washes the hose and cable to remove contaminants therefrom. The contaminated wash fluid is removed to a holding tank for later disposal at a safe site. Hydraulically driven level-wind mechanisms are attached to each spool.

8 Claims, 8 Drawing Sheets

PORTABLE SELF-CONTAINED GROUND WATER TESTING ASSEMBLY

BACKGROUND OF THE INVENTION

This invention relates to a portable assembly for testing for environmental contamination in ground water. Since the beginning of recorded time, wherever man has made his dwelling there has been waste produced. In the past and even in the present, man has isolated and removed the waste from inhabited ares for the comfort of the dwellers. To accomplish the isolation and removal of the waste it has been standard practice to dump waste into the earth's waterways and large bodies of water or to make large piles of refuse away from populated areas. To meet the demand for electrical energy and defense, man has turned to nuclear energy, which has resulted in another type of waste that even today is stockpiled often in leaking containers. In addition to creating great amounts of waste, civilization has been forced into applying chemicals to the earth in order to make the land yield larger crops.

Since soil is made up of pulverized rock, the surface of the earth is permeable and water is allowed to filter down and create large underground rivers called aquifers. These aquifers are the source of much of the fresh water that man uses to survive. Not only are the aquifers a direct source of water for man, but they also feed many of the surface bodies of water that are used as water supplies, therefore the aquifers are also an indirect supplier of fresh water.

Because of electrostatic attractions between water molecules and other molecules which can be chemical, organic and or nuclear, waste molecules are transported to aquifers that are directly and indirectly fresh water supplies for man. This results in many of the fresh water supplies now containing contaminants that are hazardous to mankind.

Because of the hazards, tests have been developed to determine if a well that has tapped into an aquifer is supplying contaminated water. There are also projects that comprise one or a number of monitoring wells, which are wells that are drilled for test purposes only. Such wells allow scientists to determine if an aquifer is contaminated and to keep a history of the well. Some of the tests in use today are able to detect contaminates in the quantities of one part per billion.

Even though scientists have highly sophisticated test procedures and equipment available to them, the methods of getting the test equipment into the wells and to the water have been relatively archaic. Prior to the present invention, two of the primary methods for getting test equipment to different well depths has been by use of human muscle or the use of portable cranes. The two methods mentioned either limited the depth that could be penetrated or inflated the cost of the tests due to the manpower required. Neither one of the methods mentioned provided any protection for umbilical cords between submerged test sensors and surface operations.

SUMMARY OF THE INVENTION

The portable sampling apparatus of the invention eliminates all need for use of human muscle by incorporating the use of a hydraulic boom system with multiple spools. The boom is positioned using hydraulic cylinders and electric or hydraulic motors. The spools which are powered by hydraulic motors allow the operator to lower test equipment into the well with minimal physical exertion. One spool lowers a hose into the well. The hose protects an umbilical cord that links the submerged equipment to surface equipment. The hose also allows the well to be purged and water samples pumped to the surface. The second spool lowers a cable attached to the test equipment to various depths.

The ground water sampling apparatus of the invention fills the need for a sampler that requires a minimal amount of human exertion to obtain fluid samples and water well data. The invention also provides protection for umbilical cords between submerged test equipment and the surface.

The present system consists of multiple independent sampling systems mounted on the back of a truck or trailer bed or any portable platform. Due to an electric generator used as a power supply, the invention is independent of outside power requirements. The generator and hydraulic pump acting together provide all the driving potential for the sampling system which includes a submersible pump system, a cable system, decontamination systems, and level-wind systems. All the systems mentioned are supported by a framework that has a boom with two spools.

One of the sampling systems is a submersible pump attached to a motor driven spool allowing the pump to be raised or lowered into a well or body of fluid at variable velocities. The second sampling system, the cable system, is also a motor driven spool that allows for an appliance of an operator's choice such as a submersible pump, bailer, discrete liquid sampler or any other ground water or liquid sampling appliances to also be raised or lowered into a well at variable velocities. Both sampling systems can be operated concurrently. The sampling systems allow for easy acquisition of data and fluid samples for the scientist.

The decontamination system includes fresh cleaning fluid and grey cleaning fluid storage, a hot high pressure washer with wand, catch pan with transfer pump and decontamination boxes for each hose and cable. The decontamination system insures sanitary conditions when storing the equipment, in addition to lowering the risk of cross contamination of wells.

The motor driven level-winds insure that hose or cable is coiled onto its respective spool in a uniform manner which insures that there will be enough spool capacity and that no damage due to improper winding of hose, cable or electric cable will occur.

THE DRAWINGS

A preferred embodiment of the invention is shown in the attached drawings, in which.

Figure 6B:
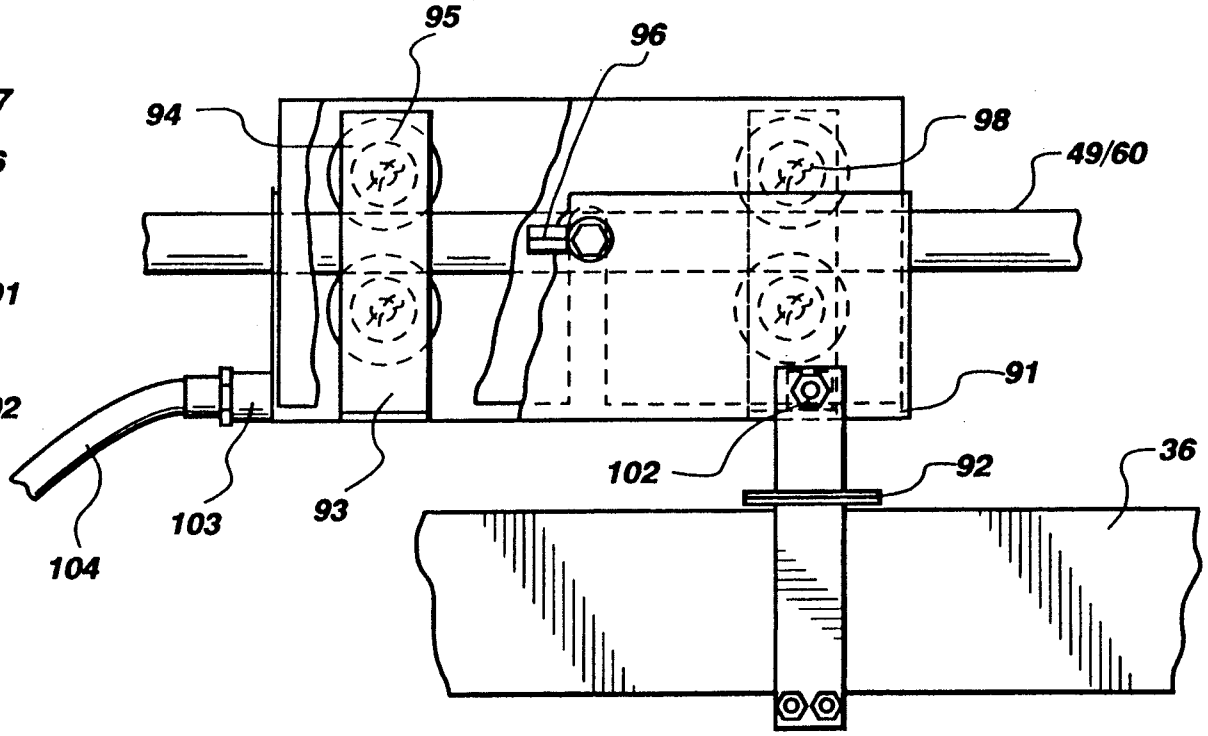
Figure 6A:
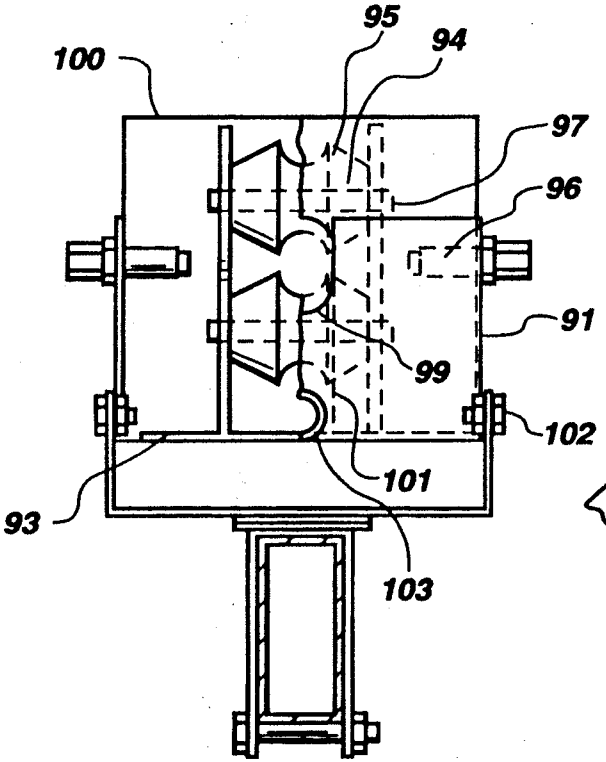
Figure 7:
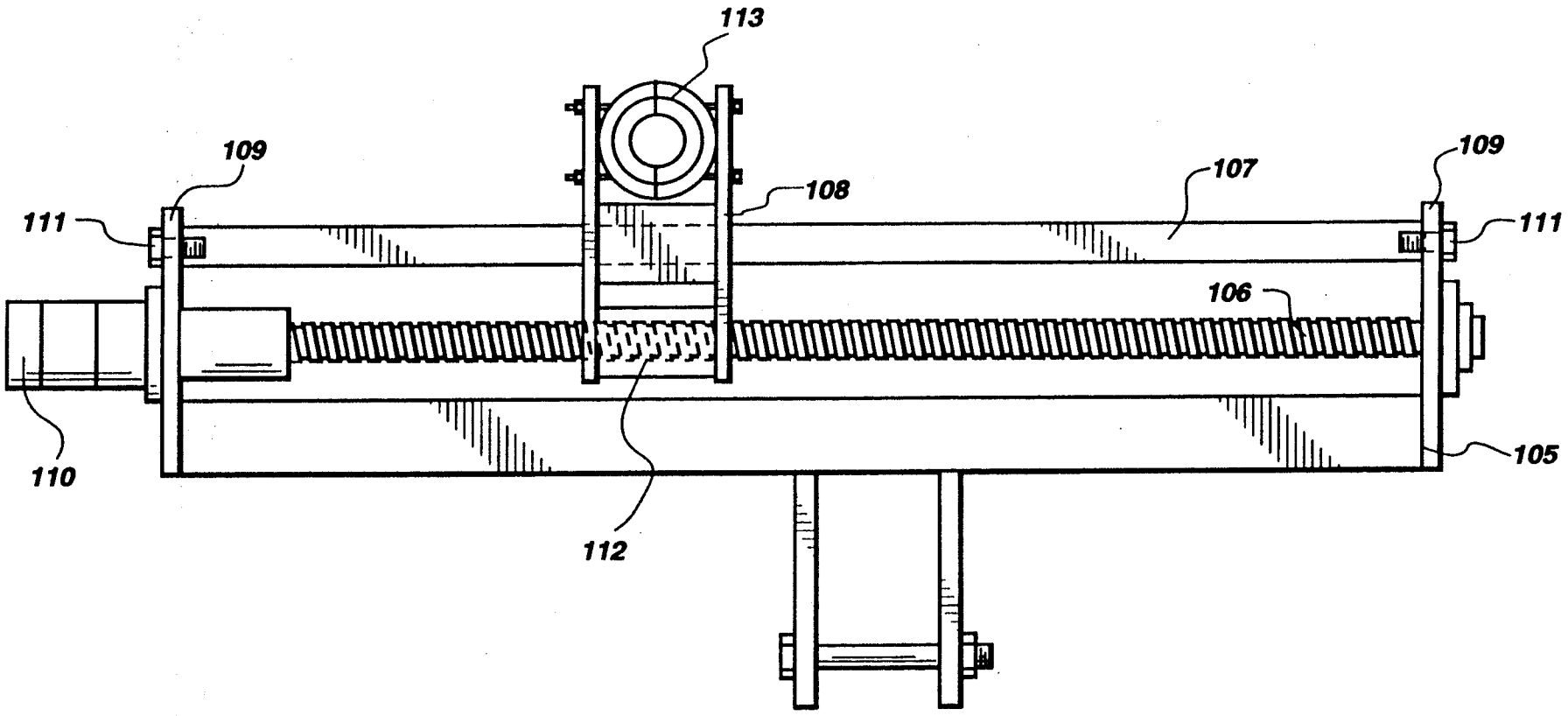

FIGS. 6*a* and 6*b* are a detailed view of the decontamination system for recovering contaminants from the hose and cable;

FIG. 7 is a detailed view of the level-wind system for the hose and cable; and

Figure 8:
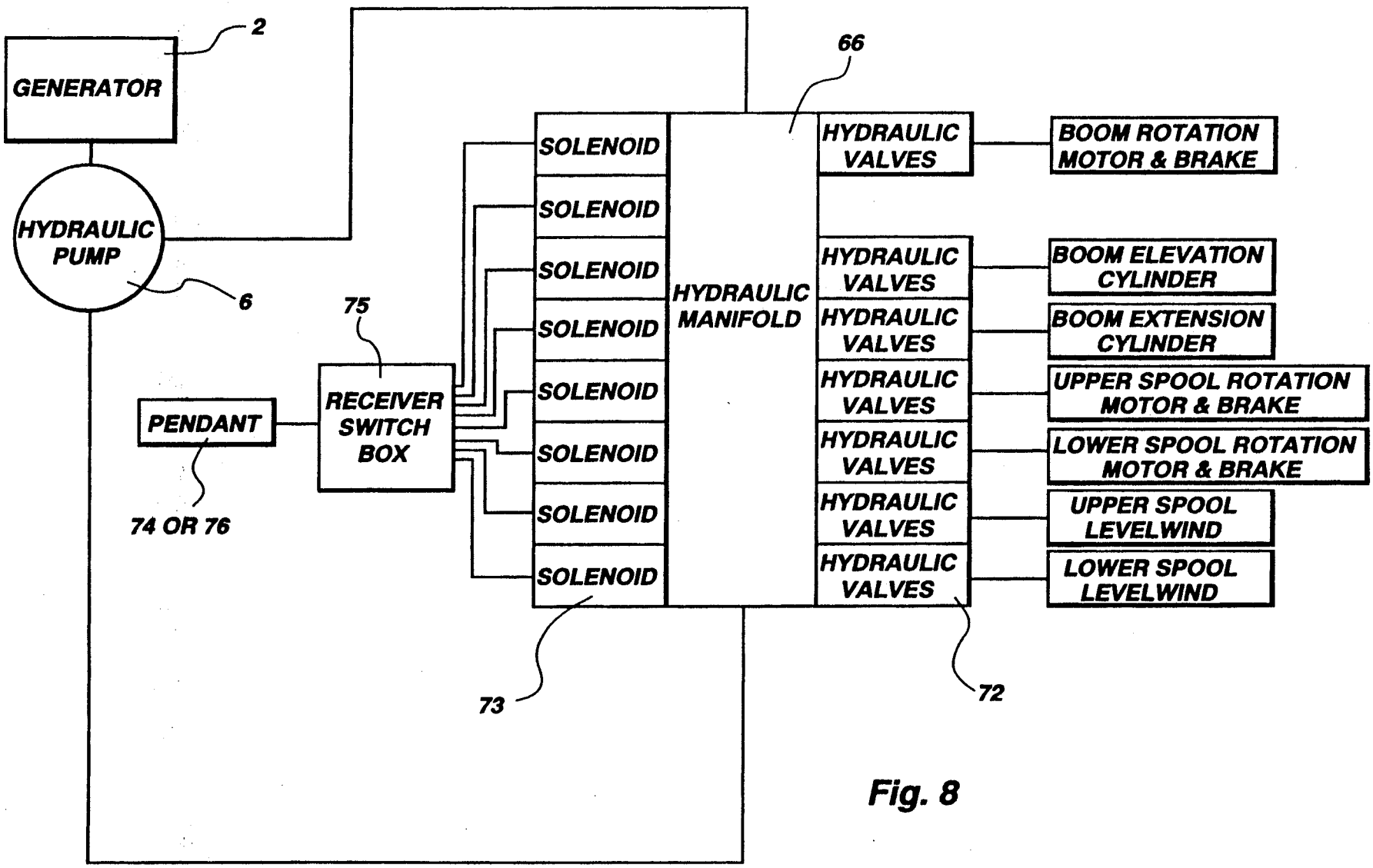

FIG. 8 is a schematic of the hydraulic system for operating the component parts of the portable testing apparatus.

DETAILED DESCRIPTION OF THE DRAWINGS

Figure 1:
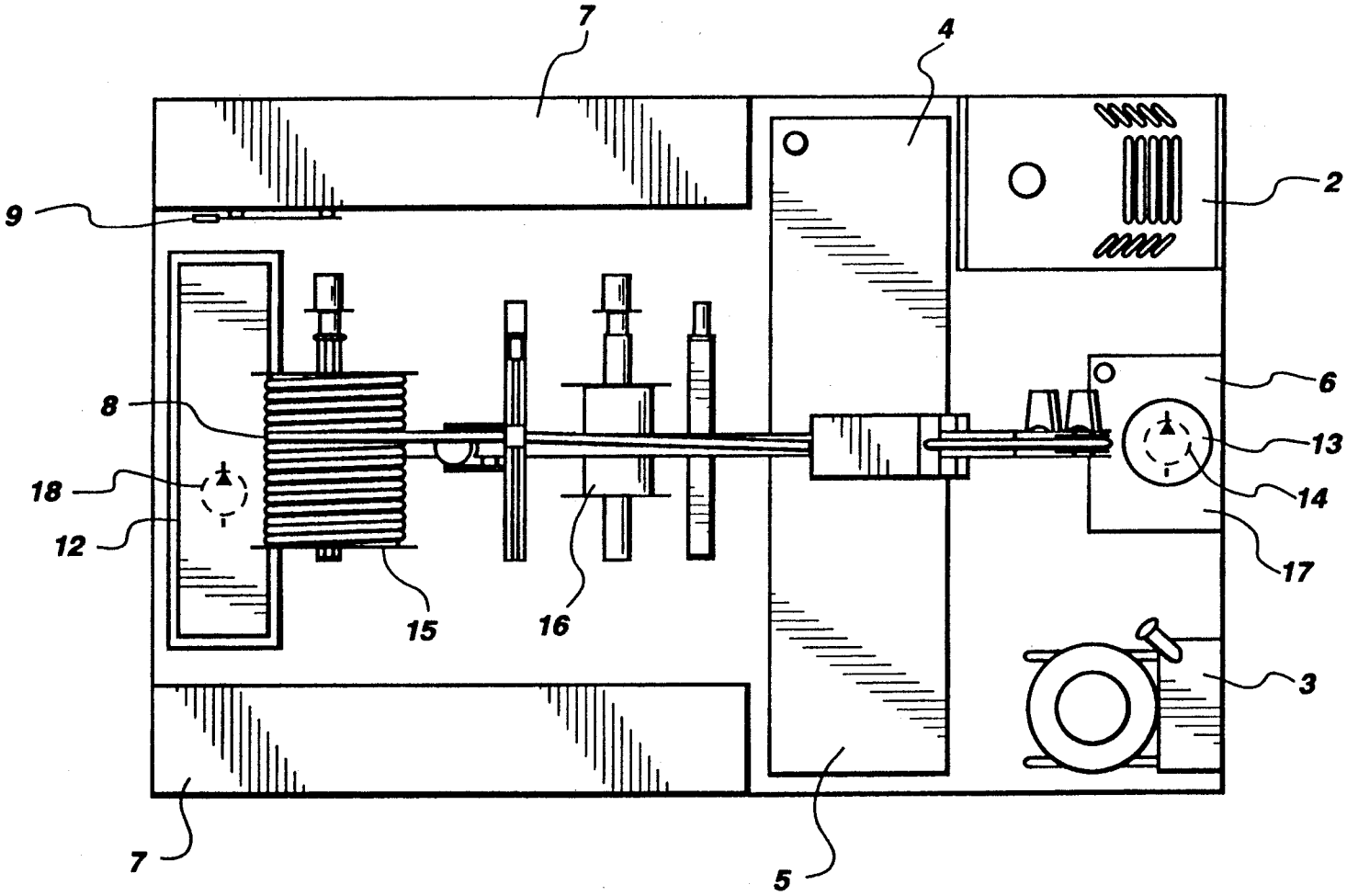
FIG. 1 is a top plan view of a portable apparatus of the invention mounted on the bed of a truck.
Figure 2:
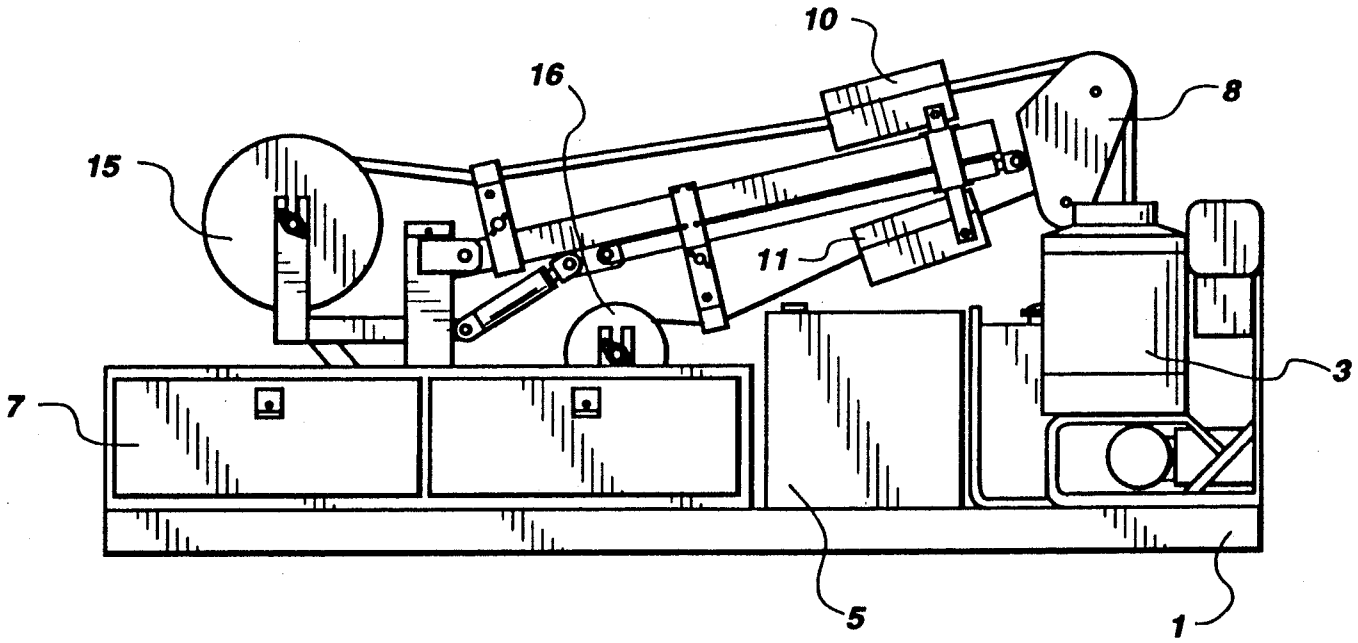
FIG. 2 is a side elevational view of the portable apparatus shown in FIG. 1.

As shown in FIGS. 1 and 2, there are a number of individual systems comprising the invention, all of which are mounted in a preferred embodiment on a truck or trailer bed 1. The support systems include an electrical generator 2, a hot high pressure washer 3, fluid storage for both fresh fluid 4 and grey fluid 5 and a hydraulic system 6. In addition to the support systems mentioned, there are also tool boxes for storage of equipment 7. The support systems allow for the operation of the boom 8 which is the heart of the system. The electric generator 2 is capable of producing enough electricity to fulfill all the electrical requirements of the apparatus. The high pressure washer 3 supplies hot pressurized fluid or ambient fluid for cleaning. The cleaning fluid is supplied to a wand 9, similar to the type used at coin-operated car washes, and also to two decontamination boxes 10, 11 which are discussed later in the descriptions. A fresh water storage tank 4 supplies uncontaminated cleaning fluid to the high pressure hot fluid washer 3. When the cleaning fluid has been cycled through either the cleaning wand or the decontamination boxes, it is considered contaminated. The contaminated fluid is collected in a catch pan 12; and then a transfer pump 18, mounted in line with the catch pan, pumps the contaminated cleaning fluid into a separate storage tank called the grey water storage 5.

In this preferred embodiment, all movement of the boom is accomplished through the use of motors and cylinders. The hydraulic generating system 6 consists of an electric motor 13 which draws its power from the electric generator. The electric motor drives a hydraulic pump 14, which in turn supplies the boom 8 with a hydraulic driving force large enough to rotate, elevate and extend the boom, in addition to rotating the upper spool 15 and the lower spool 16. The hydraulic generating system 6 also has its own oil reservoir 17. Hydraulic power can also be taken from a truck power takeoff if a hydraulic generating system is not built into the embodiment.

All of the previously described systems are subsystems to the boom, and contribute to the proper operation of the boom. The boom can be divided into six different components which consist of the:

1. Frame
2. Upper spool assembly
3. Lower spool assembly
4. Hydraulic system
5. Decontamination box (system)
6. Level-wind system.

Figure 3:
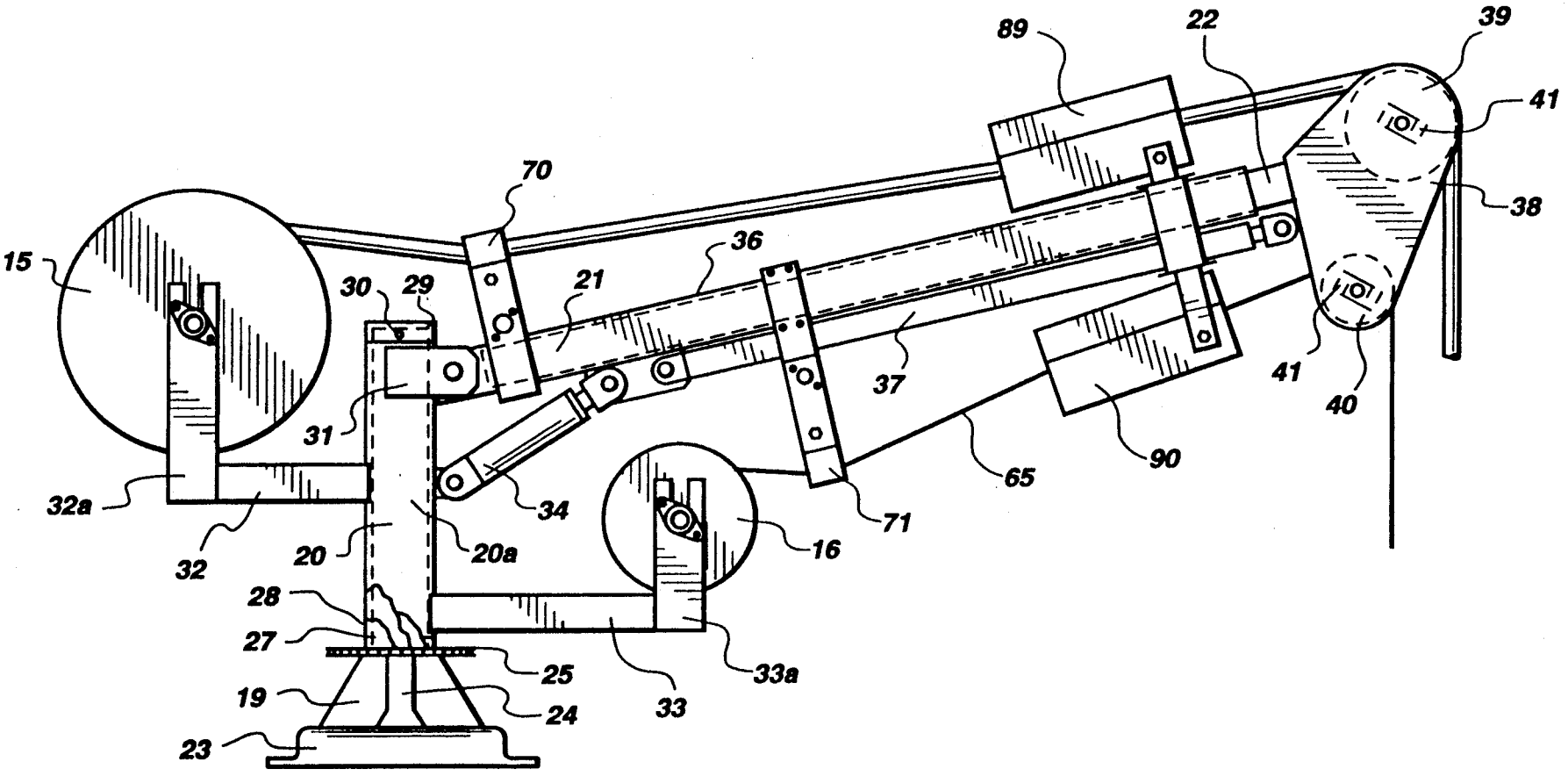
FIG. 3 is a partial side elevational view of the portable apparatus, showing the boom and reels.
Figure 4:
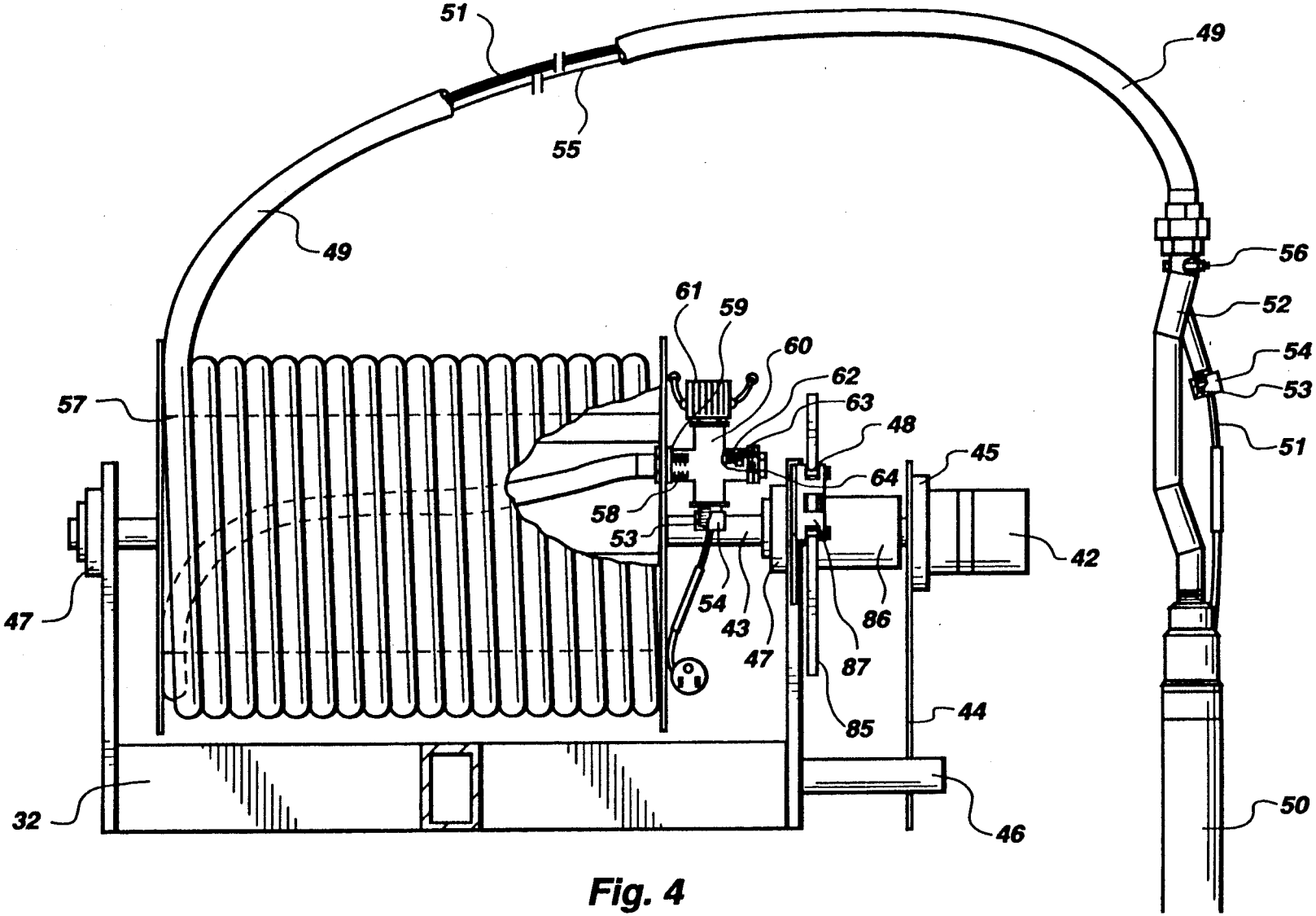
FIG. 4 is a detailed view of the hose reel of the portable apparatus shown in FIGS. 1–3.

Referring to FIG. 3, the frame consists of a mast 19, primary frame 20 and a boom arm 21 with its extension 22. The mast comprises a base plate 23, pivot column 24, and rotation sprocket 25. The base plate 23 is a reinforced piece of rectangular steel plate anchored to the frame of the truck, trailer bed, or skid 1. The function of the base plate 23 is to provide support for the boom 8. Welded to the center of the base plate is the pivot column or mast 24. The purpose of the pivot column is twofold; the first being to support the primary frame 20, and the second purpose being to act as a hinge for rotation of the primary frame. Near the base of the pivot column 24 is attached the rotation sprocket 25. The rotation sprocket 25 also serves two purposes. The first purpose is to act as a table for the primary frame 20 to rest and swivel upon, and the second function is being the stationary sprocket in a planetary sprocket system 26 used for the rotation of the boom.

The second component of the frame, the primary frame 20, encircles mast 19, and rests upon the rotation sprocket 25. The primary frame 20 consists of a pipe 20*a* that has an inner diameter slightly larger than the column used for the pivot column 24. In the ends of pipe 20*a* bushings 27 and lubrication fittings 28 are installed to provide for a precision fit and lubrication between the mast 19 and the primary frame 20. To hold the frame on mast 19, a mast cap 29 is attached at the top of mast 19 and secured with a bolt 30 that runs through both the cap and the mast. At the top of and on the forward side of the primary frame pipe 20 are two brackets 31. The purpose of the brackets is to support the boom arm 21. Half way down the rear of the primary frame pipe 20 an arm 32 is attached to the primary frame 20 center pipe and at the end of the arm a saddle 32*a* is attached to support the upper spool 16. Arm 32 is positioned so that the top of the hub of the upper spool 15 is positioned on a plane slightly above the top of the mast cap 29.

Approximately one third of the way up the primary frame pipe 20 and protruding to the front is another arm 33. At the end of arm 33 is another saddle 33*a* which holds the lower spool 16. The lower spool 16 is supported so that the top side of the spool is in a plane just below the bracket 31 that supports the boom arm 21. Just above the arm that supports the lower spool saddle 33*a* an elevation cylinder 34 is pivotally attached to frame 20 to support the lower end of boom arm 21.

Figure 5:
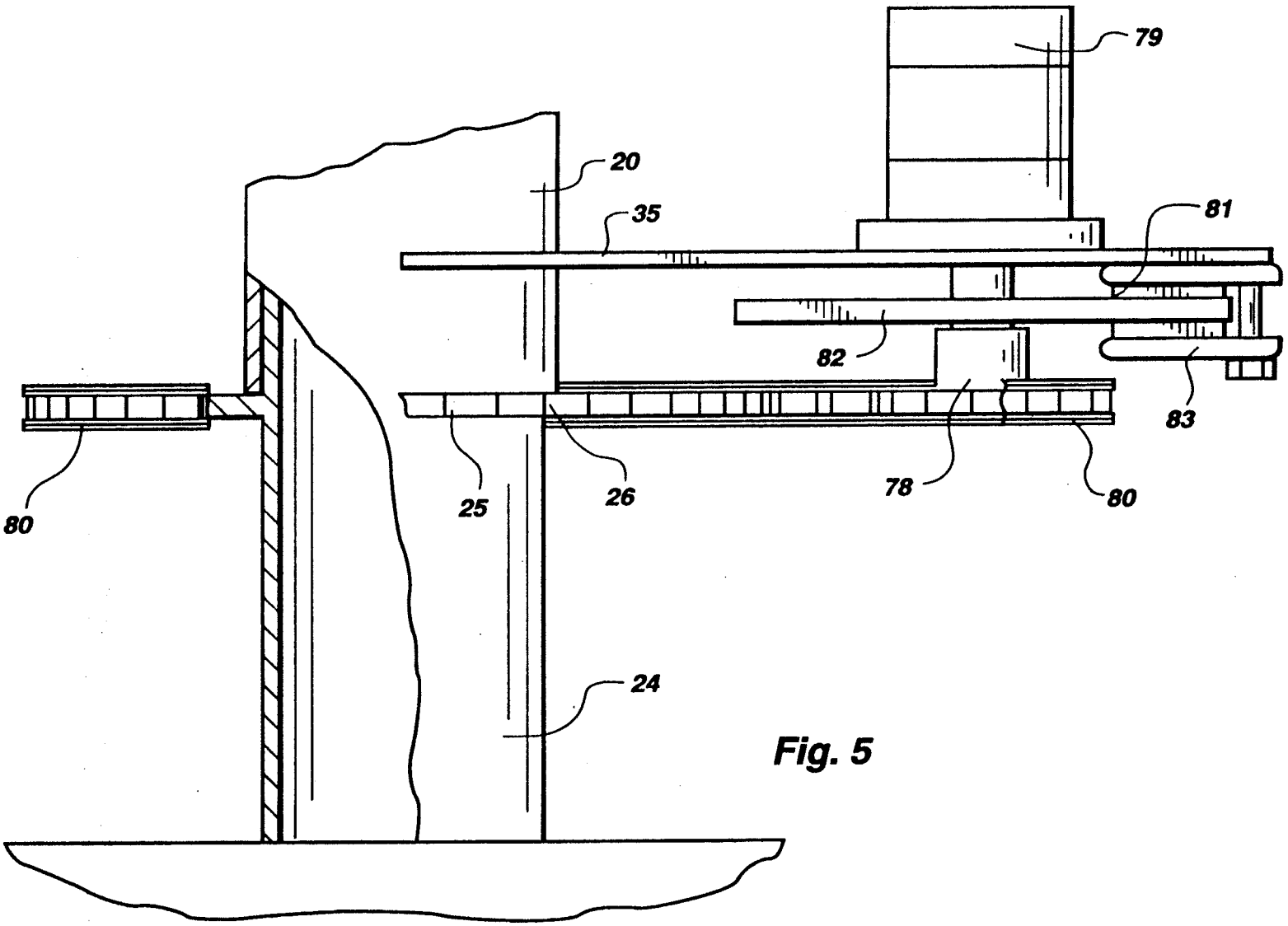
FIG. 5 is a detailed view of the rotational mechanism for rotating the boom.

As shown in FIG. 5, a bracket 35 is attached to the base of primary frame 20. The purpose of the bracket is to support a motor and brake, the function of both the motor and brake are described below. The boom arm 21 is attached to the bracket 31 located on the top of the primary frame 20.

As shown in FIG. 3, boom arm 21 is comprised of two components, primary boom arm 36 and boom arm extension 22. Boom arm 21 is attached to the top of the primary frame 20 at brackets 31. About one quarter of the way from the end of the primary boom arm 36 boom elevation cylinder 34 is attached at its other end. The lower end of boom extension cylinder 37 is rotatably attached to boom arm 36. At the free end of the primary boom arm 36 the boom arm extension 22 is inserted inside of the primary boom arm. A double sheave head 38 is attached to the end of the boom arm extension 22. Just in front of the sheave head 38 is the attachment point for the boom extension cylinder 37. The boom head 38 is configured so that the upper spool sheave 39 is located forward and above the lower spool sheave 40. On the side of the boom 38 head and collinear with the sheave axle lines are two mounts for hose/cordage meters 41.

The mast 19, primary frame 20 and boom arm 21, when combined, form the frame that supports the rest of the boom.

The most prominent of the remaining components of the boom is the upper spool assembly 15. The upper spool assembly 15 rests in the saddle 32*a* that is at the rear of the boom. Rotation of the spool is provided by a motor 42 coupled to one end of the spool axle 43. The motor 42 is held in a stationary position by a torque arm 44 that is attached to the motor frame 45 at one end and secured by a stirrup 46 at the other end. The spool 15 is supported in the saddle 32*a* on both ends by flanged bearings 47; and unwanted rotation is prevented by a disc brake 48 attached to the driver end of the spool.

Coiled on the upper spool 15 is a hose 49 with a portable submersible pump 50 attached to the free end that can be lowered into a well or body of fluid. The submersible pump 50 is supplied with power by a set of insulated electrical wires 51 that are enclosed inside the hose. At the bottom end of the hose between the hose 49 and the submersible pump 50 is a Y-type assembly 52. The purpose of the Y-assembly 52 is to provide a way for the electrical wires 51 to exit the inside of the hose 49 and connect to the submersible pump 50. The seal around the electrical wire is made by a teflon ferrule 53 and compression nut 54 on the arm of the Y-assembly 52 that the electrical leads 51 exit through. In addition to the electrical wires 51 inside the hose, there is a stainless steel cable 55 or a cable with a chemically inert protective covering that also runs the entire length of the hose. The stainless steel cable 55 is needed to act as a strain relief for the hose 49 when it is lowered into a well or body of fluid. Strain relief is needed to prevent damage to both the hose 49 and the electrical wires 51 when a load is applied to the hose 49 due to the weight of the hose, the weight of fluid in the hose as it is being pumped and the effects of water (fluid) hammer. The strain relief cable is looped around a bolt 56 that runs through the leg of Y-assembly 52 securing the lower end of the hose 49 to the cable 55.

The upper end of the hose 49 is attached to the upper spool 15 by allowing the hose to enter the interior portion of the spool hub 57 and then inserting the male threads of the hose end 58 through a hole 59 in one end of the spool 15. The exit hole 59 for the hose threads 58 is only large enough for the threads to fit through which allows for a pipe fitting to be used as a locking device when it is attached to the end of the hose. The fitting that is attached to the hose 15 is a galvanized cross 60. The galvanized cross 60 is used to provide an exit for the pumped fluid, an exit for the electrical wires 51 and a place to anchor the strain relief cable 55. The first remaining port on the galvanized cross has a cam-lock 6 fitting attached to it. The cam-lock allows the port to be either capped off or a hose attached so that the fluid being pumped by the submersible pump can be directed to a container. The second remaining port on the galvanized cross 60 allows for the sealed exit of the electrical wires 51 that go to the submersible pump 50. Like on the lower end of the hose 49 the seal is made by a teflon ferrule 53 and a compression nut 54. The remaining port on the galvanized cross 60 is used as an anchor port for the strain relief cable 55. The anchor for the strain relief cable 55 consists of a plug 62 that has been drilled along the central axis perpendicular to the threads with a hole slightly larger than the diameter of strain relief cable. The outside end of the hole is then enlarged and tapped turning the plug into a housing 62. The cable 55 is inserted through the hole in the housing 62, pulled tight and a then sleeve 63 is attached to the end of the cable 55. The housing 62 is then sealed by screwing a plug 64 into the housing 62.

The lower spool 16 is very similar to the upper spool 15. The methods incorporated to support and drive the two spools are the same; but, where the function of the upper spool 15 is to provide a submersible pump with a means of operation, the lower spool 16 is intended to raise and lower a variety of appliances into and out of a well or body of fluid. Therefore the lower spool assembly 16 has only a cable 65 coiled on it allowing the operator to attach a variety of different appliances to the end of the cable. Keep in mind though that the lower spool 16 can also be used to operate a system similar to the one described for the upper spool 15.

All motion associated with the boom assembly is accomplished through the use of motors and cylinders. The hydraulic driving force is provided by a hydraulic pump 6 powered by the system generator 2 or from the power takeoff of the transport vehicle. From the hydraulic pump 6 pressurized oil is sent to a manifold 66 that has the capability to control the flow of oil for all the hydraulically powered functions of the boom 8 system. The functions include:

1. The boom rotation.
2. The boom rotation brake 67.
3. The boom elevation cylinder 34.
4. The boom extension cylinder 37.
5. The upper spool rotation.
6. The lower spool rotation.
7. The upper spool brake 68.
8. The lower spool brake 69.
9. The upper spool level-wind 70.
10. The lower spool level-wind 72.

The flow of oil is turned on or off to each of the functions with valves 72 that are opened or closed by electric solenoids 73. The solenoids 73 and valves 72 are attached to the manifold 66. Therefore oil is allowed to enter the manifold 66, flow through a valve 72 if it is opened, flow to the appropriate hydraulic mechanism, back to the manifold 66 and finally back to the hydraulic pump and reservoir 6 to be recirculated again. The valves 72 also have the ability to control the direction of oil flow allowing for the reversal of a hydraulic function. The opening and closing of the valves 72 are signaled by a pendant 74 that transmits radio signals to the manifold via a receiver switch box 75 or by a pendant 76 that is linked to manifold 66 by an electrical cord 77. Use of the pendant 74 or 76 allows for the operation of the sampling system where hazardous conditions may not allow personnel to be present.

As shown in FIG. 5, boom rotation is accomplished by means of a planetary sprocket system 26. The rotation sprocket 25, welded to the lower end of the pivot column 24, is the stationary or center sprocket of the boom rotation system. The planet sprocket 78 is attached to a motor 79 mounted on the boom rotation bracket 35 that protrudes from the side of the base of the primary frame 20. The planet sprocket 78 and the stationary sprocket 25 are connected by a loop of roller chain 80 which causes rotation of the boom 8 when the boom rotation motor 79 is activated.

Unwanted rotational motion of the boom is prevented by use of the boom rotation brake 81. The brake 81 is a disc caliper system that has the disk 82 attached to the planet sprocket 78 of the boom rotation system 26 and the caliper 83 is mounted to the same bracket 35 as the boom rotation motor 79. The brake 81 is activated by lack of oil pressure therefore the boom rotation brake 81 and the boom rotation motor 79 are controlled by the same control on the pendant 74 or 76. When the boom 8 is not being rotated the boom rotation brake 81 is activated and when the boom rotation motor 79 is activated the calipers 83 are released and the boom 8 is allowed to rotate.

The boom elevation and extension cylinders 34 and 37 are two way cylinders attached to the primary frame 20, primary boom arm 36 and the boom arm extension 22. Each cylinder has its own up and down control on the pendant 74 or 76.

Rotation of the upper spool 15 is accomplished by the use of a motor 42 mounted on a torque arm 44 with the output shaft coupled to the endshaft of the upper spool 15. Forward and reverse motion of the spool is controlled at the pendant 74 or 76. Unwanted rotational motion of the upper spool is controlled with the same type of disc caliper brake as is used for the boom rotation brake 81. The disc 85 is attached to a coupler 86 between the motor 42 and the upper spool 15 endshaft. The upper spool brake caliper 87 is mounted on a bracket that is attached to one of the saddle arms that support the upper spool 15.

Rotation and braking of the lower spool is done using the same methods as are used for the upper spool.

The last two mechanisms driven by hydraulics are the level-winds for the upper and lower spools 70 and 71. A more detailed description of the level-winds will follow but for now the important thing to note is that the level-winds are driven by motors attached to one end of the level-wind frame. Each motor is reversible and has its own control on the pendant 74 or 76.

As a final note about the hydraulics, the rate of oil flow to each mechanism can be adjusted. The adjustment allows for control of the velocity of the boom rotation, spools, cylinders and level-winds, as shown in FIG. 8.

Another important feature of the invention is shown in FIG. 6, and includes upper and lower decontamination boxes 89 and 90. The purpose of the decontamination boxes 89, 90 is to eliminate any impurities that may have clung to the hose 49 or cables 65 while submerged in a well or body of fluid. A separate decontamination box is supplied for each hose or cable. A decontamination box consists of a two piece box, a set of roller guides 95 and a set of nozzles 96. All parts of the decontamination box are constructed of noncorrosive materials.

The lower part of the two piece box 91 acts as the frame for the decontamination system. The lower portion of the box 91 is mounted to the boom 8 with a swivel bracket 92. Inside and towards each end of the lower box are mounted two brackets one towards each end. Each bracket 93 supports two sheave type rollers 94. Together the brackets and rollers make up the roller guides 95. The sheaves 94 are supported using smooth round pins 97 for axles and hairpin clips 98 to keep the axles 97 in place during operation. There is a notch 99 cut in the upper edge of the lower half of the decontamination box 91 on each end to act as entrance and exit for the hose 49. The center of the notches 99 and roller guides 95 are all collinear. Mounted on each side of the lower box half 91 and at the same level as the center of the entrance notches 99 and roller guides 95 are two high pressure spray nozzles 96. During operation the nozzles 96 are supplied with pressurized cleaning fluid that can be heated if necessary from the pressure washer 3. To contain all the fluid while the decontamination box is in operation the upper portion or lid 100 of the decontamination box has been designed to fit inside the lower portion of the box 91 with sides that reach to the bottom of the lower box 91. Notches 101 have been made in the lid to accommodate the entrance and exit for the hose 49, nozzles 96, and mounting bolts 102. On the low end of the box a discharge port 103 and hose 104 allow for the drainage of contaminated fluid.

The travel of the hose 49 or cable 65 takes the following path through the decontamination box. Since the hose 49 or cable 65 runs bidirectional it enters the box through the notch 91 at the front or rear of the box then goes through the nearest set of roller guides 95. Next the hose travels between the nozzles 100 on to the second set of roller guides and finally exits the box at the front or rear of the box. During normal operation the nozzles 100 remain dormant when the hose or cable is being dispersed and are activated when the hose or cable is being retracted. Contaminated cleaning fluid is drained through the discharge port 103 and hose 104 at the low end of the decontamination box. It should be noted here that any parts of the hose 49 or cable 65 that have not been cleaned can be decontaminated using the high pressure wand 9 and catch pan 12.

As shown in FIG. 7, a further component of the boom is the level-wind systems for the upper and lower spools. The purpose of the level-winds is to recoil the hose and cable uniformly on the spools thereby insuring enough spool capacity and preventing damage to the hose or cable. The prominent parts of a level-wind are the frame 105, screw 106, slide 107 and the guide 108. The construction of a level-wind is the same for an upper level-wind or a lower level-wind. The only difference is that the lower level-wind is mounted upside down relative to the upper level-wind therefore only the upper level-wind will be described.

The frame 105 consists of a piece of rectangular tubing with ears 109 welded to each end. The ears are pointed in an upward direction and are the support for the screw 106 and the slide 107. Slightly off center on the bottom side of the rectangular tubing a bracket is welded to attach the frame to the primary boom arm 36. The screw 106 uses the first set of mounting holes on the ears above the rectangular tubing. On one end of the screw 106 is the hydraulic drive motor 110. That is bi-directional and is mounted directly on the ear. Coupled to it is a piece of all thread 106 that extends to the other ear where it is supported by a flanged bearing. In the remaining set of holes the slide 107 is mounted. The slide 107 is made of a smooth noncorrosive rod that is bored and tapped on each end and held in place on both ends by threaded studs 111 that go through the remaining holes in the ears 109 into the ends of the rod. The guide 108 is made of two pieces of flat plate joined together by a sleeve to accommodate the slide 107 at the center and a threaded sleeve 112 compatible to the screw 106 that spans the ears of the frame. On the top end of the guide a two piece hose guide 113 made from a low friction material is supported between the two pieces of plate by two bolts.

The level-wind operates as follows. As hose 49 or cable 65 is dispersed from or retracted on the spool the motor 110 that drives the screw 106 is activated and turns the screw which causes the guide 108 to move to the left or the right. Since the hose travels through the hose guide 113 which is a part of the guide 108 the hose is directed onto the spool at whatever location the guide is at relative to the spool. The rotation of the drive motor 110 for the screw 106 is calibrated so that the hose will be wound back on the spool uniformly.

While this invention has been described and illustrated herein with respect to preferred embodiments, it is understood that alternative embodiments and substantial equivalents are included within the scope of the invention as defined by the appended claims.

I claim:

1. A portable ground water testing apparatus comprising in combination:

a boom member rotatingly attached to a portable bed, said boom member being both horizontally pivotable about a vertical axis and vertically pivotable about a horizontal axis; said boom member further having slide members to accommodate the movement of cables and hoses along the length of the boom member;

at least two independently operable reel members attached to said boom member for storing and feeding cables and hoses to said boom member;

at least one decontamination apparatus having a chamber with a forward and a rearward aperture for a hose and a cable to pass through said chamber, said chamber having a spray wash device for spraying the hoses and cables with wash fluid to remove contaminants, and means for removing the contaminated wash fluid from the chamber;

a holding tank for accepting and storing the contaminated wash fluid from the decontamination apparatus; and a device for maintaining a uniform winding of cables and hoses on each of said reel members.

2. An apparatus as set forth in claim 1, wherein said apparatus is powered by hydraulics.

3. An apparatus as set forth in claim 1, wherein said apparatus is powered by electric motors.

4. An apparatus as set forth in claim 1, wherein said apparatus includes a portable electrical power generator and a hydraulic pumping system for powering the component parts of said apparatus.

5. An apparatus as set forth in claim 1, including a fresh cleaning fluid holding tank for supplying the decontamination apparatus with fresh cleaning fluid.

6. An apparatus as set forth in claim 1, wherein said boom member has an extendable arm to extend the length of the boom member.

7. An apparatus as set forth in claim 1, wherein said apparatus is attached to the bed of a truck.

8. An apparatus as set forth in claim 1, wherein said apparatus is attached to the bed of a portable trailer.

* * * * *